United States Patent [19]

Kentosh

[11] Patent Number: 4,650,431

[45] Date of Patent: Mar. 17, 1987

[54] QUICK DISCONNECT STORAGE PRODUCTION TERMINAL

[75] Inventor: James M. Kentosh, Los Angeles, Calif.

[73] Assignee: Amtel, Inc, Providence, R.I.

[21] Appl. No.: 187,458

[22] Filed: Sep. 15, 1980

Related U.S. Application Data

[63] Continuation-in-part of Ser. No. 24,609, Mar. 28, 1979, Pat. No. 4,254,523.

[51] Int. Cl.[4] ..... B63B 21/50

[52] U.S. Cl. ..... 441/5; 114/230; 441/4; 441/21

[58] Field of Search ..... 9/8 P, 8 S; 114/230; 441/2, 3, 5, 21

[56] References Cited

U.S. PATENT DOCUMENTS

| | | | |
|---|---|---|---|
| 3,295,489 | 1/1967 | Bossa | 114/230 |
| 3,335,690 | 8/1967 | Busking | 114/230 |
| 3,407,768 | 10/1968 | Graham | 441/5 X |
| 3,525,312 | 8/1970 | Beck | 9/8 P |
| 3,543,526 | 12/1970 | O'Neill et al. | 441/21 X |
| 3,664,388 | 5/1972 | Frankel | 9/8 P |
| 3,722,223 | 3/1973 | Gratz | 9/8 P |
| 3,899,990 | 8/1975 | Lecomte | 9/8 P |
| 4,065,822 | 1/1978 | Wilbourn | 114/230 |
| 4,114,556 | 9/1978 | Orndorff et al. | 114/230 |
| 4,262,620 | 4/1981 | Nooteboom | 114/230 |
| 4,321,720 | 3/1982 | Havre | 441/5 |
| 4,490,121 | 12/1984 | Coppens et al. | 114/230 X |
| 4,604,961 | 8/1986 | Ortloff et al. | 114/230 |

FOREIGN PATENT DOCUMENTS

| | | | |
|---|---|---|---|
| 956522 | 10/1974 | Canada | 114/230 |
| 1531026 | 7/1969 | Fed. Rep. of Germany | 114/230 |
| 2752266 | 5/1979 | Fed. Rep. of Germany | 114/230 |
| 2381166 | 9/1978 | France | 114/230 |

*Primary Examiner*—Robert J. Spar
*Assistant Examiner*—Janice Krizek
*Attorney, Agent, or Firm*—Freilich, Hornbaker, Rosen & Fernandez

[57] ABSTRACT

An offshore terminal is described, of the type which includes a dedicated vessel that supports a transfer structure loosely anchored as by several chains, and a fluid conduit structure that extends from the sea floor through the transfer structure to the vessel, wherein the vessel and transfer structure can be quickly disconnected to avoid potentially damaging surface conditions such as ice flows and hurricanes. The nonrotatable portion of the transfer structure, together with upper portions of the chains and underwater fluid conduit, can be detached from the rest of the transfer structure to sink below the surface, but to a predetermined depth which is considerably above the sea floor, so the vessel and a portion of the transfer structure can be sailed away from the region.

1 Claim, 8 Drawing Figures

FIG. 1
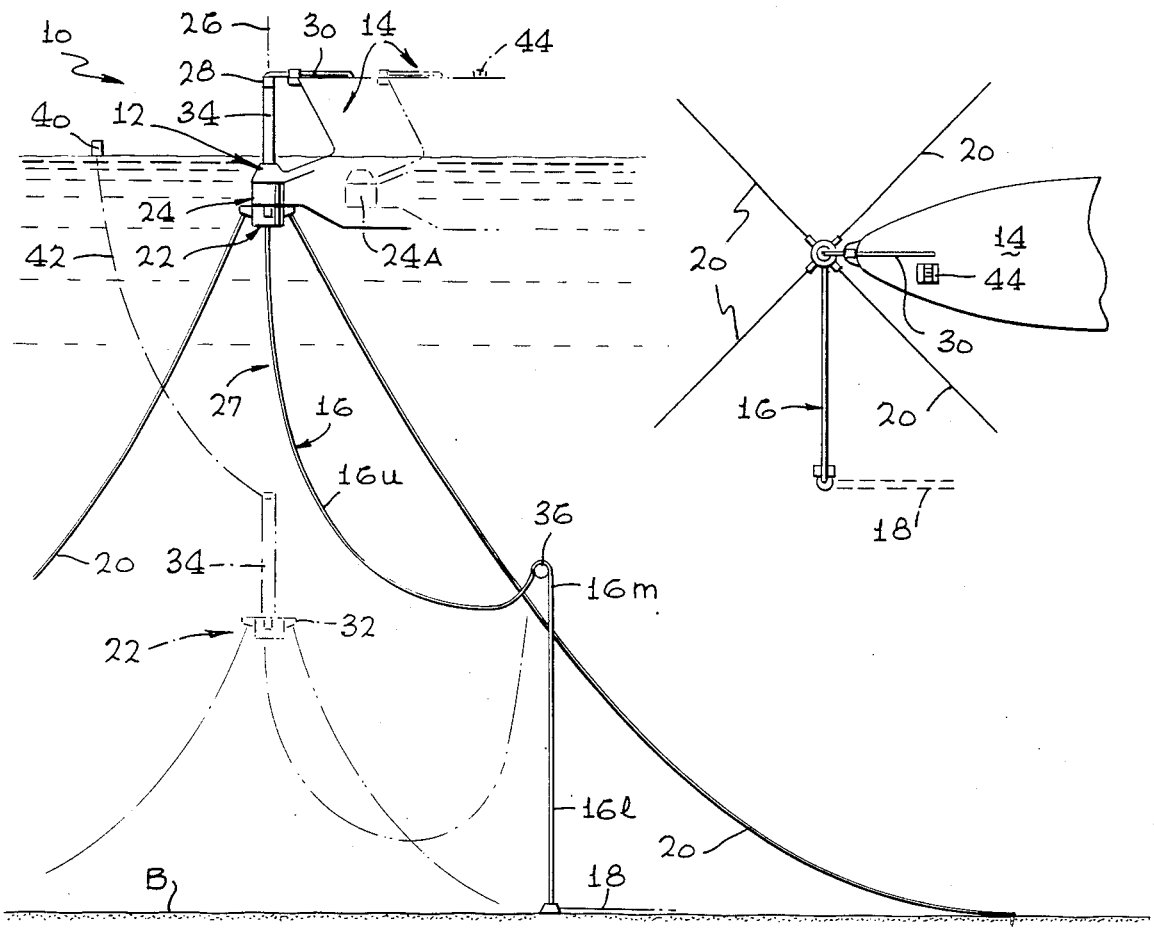
FIG. 2
FIG. 8
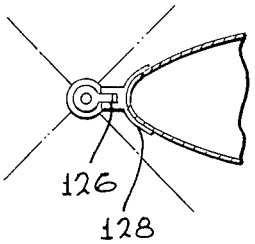
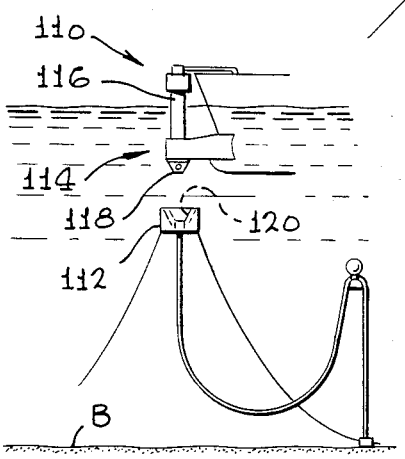
FIG. 6
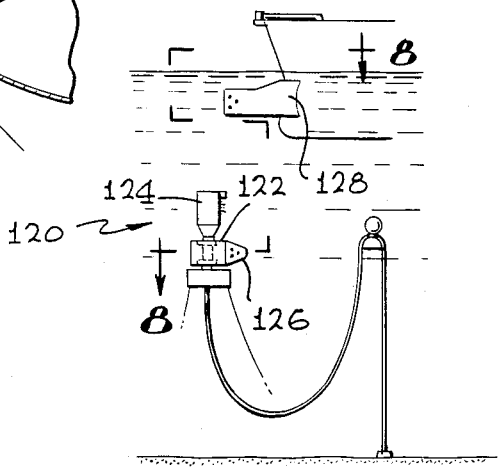
FIG. 7

QUICK DISCONNECT STORAGE PRODUCTION TERMINAL

BACKGROUND OF THE INVENTION

A relatively low cost offshore terminal, particularly for production of hydrocarbons from subsea wells, can be formed by the use of a dedicated storage vessel which floats at the sea surface and supports a transfer structure beyond an end of the vessel. The transfer structure is loosely anchored, as by several catenary chains that extend down to the sea floor, and is coupled by a flexible underwater conduit to a pipeline at the sea floor which may be connected to undersea wells. While such an installation can often substitute for a massive offshore production platform, the floating vessel may not be as sturdy as a massive platform in resisting extreme surface conditions such as ice flows and hurricanes. If the floating vessel with transfer structure could be made to avoid damage under extreme adverse conditions such as ice flows and hurricanes, then it would become even more valuable.

SUMMARY OF THE INVENTION

In accordance with one embodiment of the present invention, an offshore terminal is provided, of the type which includes a dedicated vessel which supports a transfer structure anchored by loose catenary chains or the like, and which is coupled through a flexible conduit structure to the sea floor, which enables safeguarding of the terminal from extreme adverse surface conditions. At least a portion of the transfer structure is made detachable from the rest of the transfer structure or the vessel, and the detachable portion has a buoyancy which supports only a portion of the weight of the chains and of the flexible underwater conduit. The buoyancy is selected so that the detachable transfer structure portion sinks to a level which is below the waves but considerably above the sea floor to assure that it will not rest on the sea floor and become damaged thereby.

In one installation, the underwater conduit which extends from the sea bed to the transfer structure, includes a middle portion supported by an underwater buoy, so that the upper portion of the flexible conduit lies in a hanging loop in extension between the underwater buoy and the transfer structure portion when that portion is held at the level of the vessel. The buoyancy of the detached transfer structure portion is such that it sinks to a level high enough above the sea floor to prevent the hanging loop of the flexible underwater conduit from lying on the sea floor.

The fluid conduit structure which couples the vessel through the transfer structure to the sea floor, can include a fluid swivel mounted on the vessel at a location above the transfer structure. The fluid swivel is connected by detachable couplings to the nonrotatable portion of the transfer structure. The nonrotatable portion of the transfer structure can sink free of the vessel, while the vessel continues to hold the rotatable portion of the transfer structure as well as the relatively delicate fluid swivel.

The novel features of the invention are set forth with particularity in the appended claims. The invention will be best understood from the following description when read in conjunction with the accompanying drawings.

BRIEF DESCRIPTION OF THE DRAWINGS

FIG. 1 is a side elevation view of an offshore terminal constructed in accordance with one embodiment of the present invention, showing the terminal in a functioning state and also showing it in phantom lines in a detached state.

FIG. 2 is a plan view of the terminal of FIG. 1.

FIG. 6 is a side elevation view of a terminal constructed in accordance with another embodiment of the invention, shown in a detached state.

FIG. 7 is a side elevation view of a terminal constructed in accordance with another embodiment of the invention, shown in a detached state.

FIG. 8 is a view taken on the line 8—8 of FIG. 7.

DESCRIPTION OF THE PREFERRED EMBODIMENTS

Figure 3:
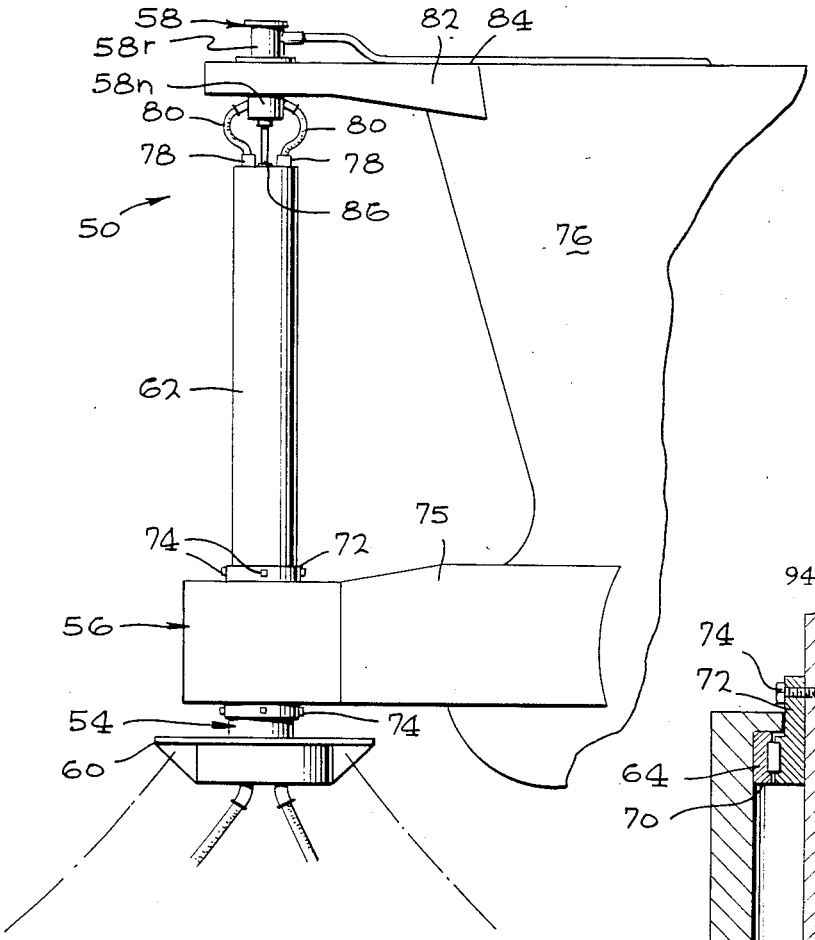
FIG. 3 is a side elevation view of an offshore terminal constructed in accordance with another embodiment of the invention.

FIG. 1 illustrates an offshore terminal 10 of the present invention, which includes a transfer structure 12 normally supported at the sea surface by a dedicated vessel 14. The transfer structure 12 is connected by a flexible underwater conduit 16 to a pipe line 18 at the sea floor, and is anchored in approximate location by a group of catenary chains 20. The terminal may be utilized to produce oil or other hydrocarbons from undersea wells to which the pipeline 18 is connected, by storing the oil in the vessel 14 until a tanker is brought alongside to remove the oil. The transfer structure 12 is prevented from drifting far from a location over the undersea pipeline 18 by the chains, and is supported at the sea surface by the dedicated vessel 14. The vessel 14 is a seaworthy structure that includes a buoyant hull which has excess buoyancy to enable it to support the transfer structure.

The transfer structure 12 includes a non-rotatable and sinkable portion 22 which is held against unlimited rotation about a vertical axis by the chains, and also includes a rotatable portion 24 that is securely fixed to the vessel 14 and which can rotate about a vertical axis 26 together with the vessel 14, to permit the vessel to align itself with wind, waves and currents. During such rotation, fluid can be pumped through a fluid conduit structure 27 which includes the flexible underwater conduit 16, a fluid swivel 28 at the top of the transfer structure, and a pipe 30 that delivers the oil to the vessel.

The terminal 10 normally can be constructed and installed at a far lower cost than a rigidly emplaced platform. However, the terminal 10 may not be able to withstand extreme surface conditions as well as a massive platform. Extreme adverse surface conditions include the presence of ice flows that can hit the transfer structure and vessel to damage them, and intense hurricances that create very large waves that may damage the vessel and transfer structure as well as the flexible underwater conduit 16. In accordance with the present invention, the relatively low cost terminal 10 can be constructed to avoid damage under extremely adverse surface conditions, by constructing the transfer structure so that at least a portion of it can be detached from the rest of it and the vessel 14. The detached portion can be sunk to under the wave level, while the vessel 14 and any remaining portion of the transfer structure can be sailed away to a safer location until the storm or other adverse condition has passed.

The nonrotatable portion of the transfer structure includes a chain table 32 at the bottom and a tall riser column 34 extending upwardly from the chain table. Substantially the entire non-rotatable portion is detached from the rotatable transfer structure portion 24, and allowed to sink.

The flexible underwater conduit 16 is formed of a flexible pipe, that functions reliably so long as it is not bent sharply. Control of the conduit configuration is achieved by utilizing a flow line support buoy 36 attached to a middle portion **16*m* of the conduit so that the lower conduit portion 16*l* extends primarily vertically when the vessel is not deflected far from its quiescent position, and so that the upper portion 16*u* of the conduit extends in a hanging loop between the buoy 36 and the non-rotatable portion 22 of the transfer structure. When the transfer structure portion 22 is detached and allowed to sink, the hanging loop 16*u* is lowered. It is important to prevent the hanging loop 16*u* from resting on the sea bottom B, because this is likely to cause severe damage to the conduit. Such damage occurs because of the possibility of sharp bending, as well as the possibility of covering the pipe with underwater debris. To avoid this, the detachable non-rotatable transfer structure portion 22 is made buoyant, in an amount that will maintain it at a depth considerably above the sea bottom B though below the wave level. The attainment of an equilibrium height of the transfer structure 22 is made possible by the fact that the weight of the chains 20 on the transfer structure decreases as the transfer structure sinks and progressively greater portions of the chains 20 rest on the sea bottom. The transfer structure portion 22** normally must sink so its top is at least five meters below average sea level (mean tide) to avoid damage from ice packs, and to significantly reduce wave action forces. Ice packs are typically in the form of large sheets of ice of perhaps several square miles area, but with their lower surface perhaps five meters below water level. Accordingly, sinking of the transfer structure below about five meters can avoid damage from ice packs. The bottom of the transfer structure portion also should lie a plurality of meters above the sea bed.

When it is safe to do so, the vessel can be sailed back (under its own power or by towing) to the location of the sunk non-rotatable transfer structure portion 22. The transfer structure portion 22 can be picked up by a marker buoy 40 attached by a line 42. The line 42 can be pulled by a winch 44 on the vessel, through the rotatable transfer structure portion shown at 24A until the previously sunk portion is in place and can be fastened securely in position.

Figure 4:
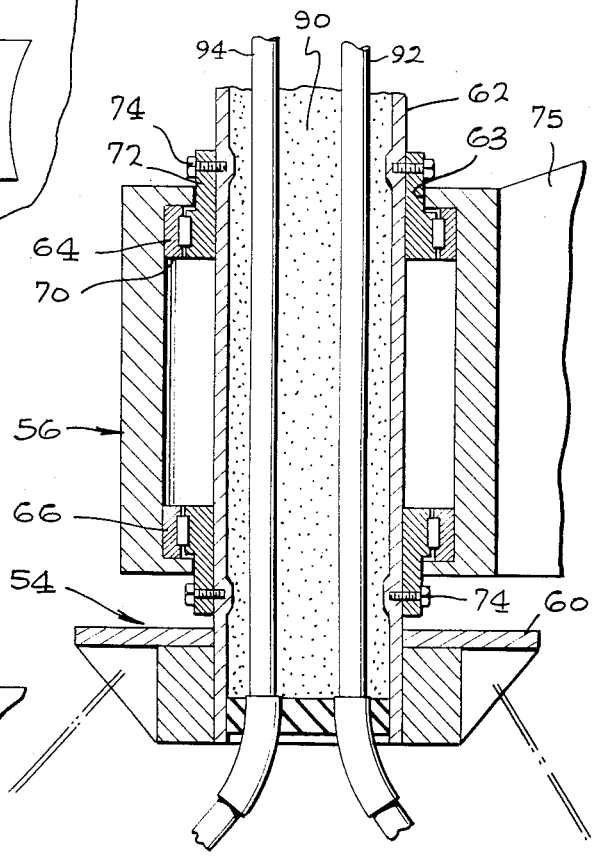
FIG. 4 is a sectional view of a portion of the terminal of FIG. 3.

FIGS. 3 and 4 show an installation 50 which includes a transfer structure having a non-rotatable portion or frame 54 that can be detached from the rotatable portion or frame 56, and wherein a fluid swivel 58 is mounted to remain with the vessel when the transfer structure portion 54 is detached to sink under the water. The nonrotatable frame 54 includes a wide chain table 60 at the bottom thereof and which lies under the rotatable frame 56, and a tall pipe support column 62 extending upwardly from the chain table and through a hole 63 in the rotatable frame 56. As shown in FIG. 4, the transfer structure includes a pair of bearings 64, 66 that rotatably support the rotatable frame 56 on the non-rotatable frame 54. Each bearing includes a rotatable part 70 fixed to the rotatable frame and a non-rotatable part 72 which is detachable from the pipe support column 62 of the non-rotatable frame. Divers can detach the non-rotatable frame 54 by loosening a group of bolts 74 on the non-rotatable bearing part 72 to detach it from the pipe support column 62. Hydraulically actuated locking devices can be utilized instead of bolts to avoid the need for divers to remove bolts. Assuming that disconnections have also been made to the fluid swivel at the top of the structure, the non-rotatable frame 54 then can be sunk by allowing the pipe support column 62 to slide down. The complete bearings 64, 66 remain with the vessel which is attached through a mooring structure 75 to the rotatable frame 56.

As mentioned above, the installation of FIG. 3 enables the fluid swivel 58 to remain with the vessel 76 when the non-rotatable frame 54 is sunk. This is accomplished by the use of couplings 78 that connect to hoses 80 leading from the nonrotatable portion **58*n* of the swivel to pipes within the support column 62. The couplings 78 permit detachment from the hoses 80 and can also permit closing of the top of the pipes to prevent the entrance of water or the leak-out of oil therefrom. Similar shut-off valves can be provided at the upper ends of the hoses 80 where they connect to the fluid swivel. The fluid swivel 58 is a relatively delicate and high maintenance item, and the ability to retain it with the vessel when a portion of the transfer structure is sunk, helps to avoid damage to the fluid swivel that might occur when it is underwater for a long period of time. This arrangement also permits personnel on board the vessel to check out the fluid swivel for damage prior to reconnection of the installation for continued production of hydrocarbons. The rotatable portion 58*r* of the fluid swivel is firmly supported by a projecting beam 82 extending from the bow of the vessel, and is connected by hard piping 84 to the vessel. The nonrotatable portion 58*n* of the fluid swivel is connected by a detachable torque coupling 86 to the nonrotatable column 62, to hold them against substantial relative rotation without requiring the hoses 80** to transmit the necessary forces.

The installation 50 therefore permits retention of the fluid swivel 58 as well as of the bearings 64, 66 that connect the transfer structure portions, or frames, with the vessel, when a portion of the transfer structure is sunk underwater. It may be noted that in FIG. 4, the non-rotatable transfer structure portion or frame 54 is formed with a buoyant chamber 90 which may be filled with air or a light material such as a foamed plastic, to provide the degree of buoyancy necessary to maintain the sunk transfer structure portion at a desired height above the sea floor. Fluid-carrying pipes 92, 94 that extend through the column 62 of the transfer structure, are permitted to pass through the chamber 90, but with the upper and lower ends of the chamber sealed against the entrance of water therein.

Figure 5:
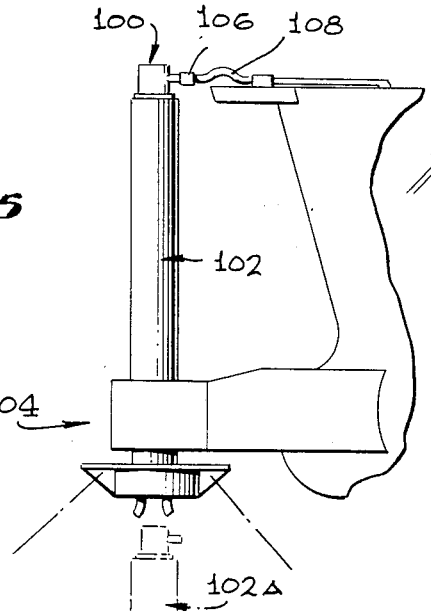
FIG. 5 is a side elevation view of a terminal constructed in accordance with another embodiment of the invention.

FIG. 5 illustrates another embodiment of the invention, similar to that of FIG. 3, but wherein the fluid swivel 100 is allowed to remain with the non-rotatable portion 102 of the transfer structure 104. A coupling 106 connects the rotatable portion of the fluid swivel to a hose 108 leading to the vessel, to facilitate disconnection of the fluid swivel so it can be sunk as indicated at 102A.

FIG. 6 illustrates another installation, wherein only the chain table 112 of the transfer structure 114 is sunk, while the column 116 of the nonrotatable transfer structure portion is allowed to remain with the vessel. This minimizes the amount of equipment that is sunk. A fluid connection is made between a coupling 118 at the bottom of the column 116 and a corresponding receptacle 120 formed at the middle of the chain table.

FIG. 7 illustrates another embodiment of the invention, wherein the entire transfer structure 120 is sunk, including the rotatable portion 122 as well as the nonrotatable portion 124. This is accomplished by the use of connectors to connect a member 126 on the rotatable transfer structure portion 122 to a bifurcated mooring structure 128 that is fixed to the vessel. This approach avoids the need to disconnect bearings that rotatably connect the transfer structure portions to each other, although it results in the sinking of a large mass.

Thus, the invention provides an improvement in an offshore terminal of the type that includes a transfer structure lying outboard of a vessel and connected thereto, and with the transfer structure loosely anchored as by several loose chains and connected through a flexible conduit to the sea floor, which permits safeguarding of the installation from extremely adverse surface conditions while permitting resumption of system use when the conditions have passed. This is accomplished by constructing the transfer structure so that at least a portion of it can be detached from the vessel so the vessel can be sailed out of the region, and by constructing the detachable transfer structure portion so that it sinks down under the waves but to a level considerably above the sea floor. Where the flexible conduit is of the type which includes a buoy connected to its middle so that there is a hanging loop extending between the middle and the transfer structure, the transfer structure can be constructed to sink to a level under the waves, but high enough so that the bottom of the depending flexible conduit loop lies above the sea floor to avoid damage to it. It may be noted that while loose mooring of the transfer structure is shown as using heavy chains extending in loose, or catenary curves, it is possible to use lighter lines such as stretchable Nylon. However, the chain weights then are not available to definitively determine the sunk depth of the transfer structure portion, and the tension in such lines as well as other means may be required to fix the sunk depth.

Although particlar embodiments of the invention have been described and illustrated herein, it is recognized that modifications and variations may readily occur to those skilled in the art and consequently, it is intended that the claims be interpreted to cover such modifications and equivalents.

What is claimed is:

1. An offshore terminal comprising:

a vessel which floats at the sea surface;

a transfer structure having a rotatable frame rigidly fixed to said vessel, and a nonrotatable frame which is supported on said rotatable frame to permit relative rotation about a vertical axis while resisting relative vertical movement to transfer forces between them;

means loosely anchoring said nonrotatable transfer structure, including a plurality of lines having lower ends anchored at spaced locations to the sea floor and upper ends attached to said nonrotatable transfer structure portion; and a fluid conduit structure extending from the sea floor through said nonrotatable transfer structure portion to said vessel;

at least part of said nonrotatable transfer structure which is attached to said lines, being detachable from the rest of said transfer structure and being constructed to sink clear of said vessel to a stable underwater depth which is above the sea floor;

said transfer structure including a rotatable bearing connecting said rotatable and nonrotatable frames, said bearing including a rotatable part mounted on said rotatable frame and a nonrotatable part;

said transfer structure also including a detachable fastener connecting said nonrotatable bearing part to said nonrotatable frame, said nonrotatable frame being constructed so it can sink when said fastener is detached therefrom, whereby the entire bearing is left with the rotatable frame when the nonrotatable frame is sunk.

* * * * *